US005790003A

United States Patent [19]

Fischer et al.

[11] Patent Number: 5,790,003

[45] Date of Patent: Aug. 4, 1998

[54] TWO PART SPACER FOR A HIGH-FREQUENCY COAXIAL CABLE

[75] Inventors: Horst Fischer; Hartmut Gohdes, both of Hanover, Germany

[73] Assignee: Alcatel Alsthom Compagnie Generale d'Electricite, France

[21] Appl. No.: 787,200

[22] Filed: Jan. 22, 1997

[30] Foreign Application Priority Data

Jan. 26, 1996 [DE] Germany ..... 196 02 754.3

[51] Int. Cl.[6] ..... H01P 1/00; H01P 3/06

[52] U.S. Cl. ..... 333/244; 174/174

[58] Field of Search ..... 333/243, 244; 174/28, 29, 167, 168, 172, 174, 175; 29/600

[56] References Cited

U.S. PATENT DOCUMENTS 3,271,506 9/1966 Martin et al. ..... 333/244 X 4,145,565 3/1979 Donon ..... 174/28

FOREIGN PATENT DOCUMENTS 1 515 832 9/1972 Germany .

1 640 711 8/1973 Germany .

*Primary Examiner*—Paul Gensler

*Attorney, Agent, or Firm*—Ware, Fressola, Van der Sluys & Adolphson LLP

[57] ABSTRACT

A spacer is indicated for a high-frequency coaxial cable with an inner conductor, a tube-shaped outer conductor and a dielectric cavity located between the two conductors which, through the use of different materials, has a higher thermal load capacity in the inner conductor area than in the outer conductor area. When installed, the parts, which are composed of different materials and are superimposed in the radial direction, are mechanically interconnected.

20 Claims, 1 Drawing Sheet

TWO PART SPACER FOR A HIGH-FREQUENCY COAXIAL CABLE

BACKGROUND OF THE INVENTION

1. Technical Field

The invention concerns a spacer for a high-frequency coaxial cable with an inner conductor, a tube-shaped outer conductor and a dielectric cavity located between the two conductors which, through the use of different materials, has a higher thermal load capacity in the inner conductor area than in the outer conductor area.

2. Description of the Prior Art

High-frequency coaxial cables (HF cables) of different sizes are used mainly as antenna conductors for transporting HF-energy between an antenna and a transmitter-receiver station. A dielectric with a low dielectric constant and low dielectric loss is required between the two conductors to obtain the lowest loss of HF energy possible. This can be achieved with a dielectric cavity by selecting a suitable insulation material for the spacer. Such an insulation material is polyethylene. The spacer can be in the form of disks or individual supports which are attached to the inner conductor at a radial distance from each other and are used to support the outer conductor. In a preferred configuration, a strand of insulation material, which is helically wound around the inner conductor, is used as the spacer.

The HF cable is heated by the transmission of HF energy. The highest temperature occurs at the inner conductor. The spacer must be configured so that it retains its shape when the inner conductor reaches its maximum temperature. DE-C-1 640 711 describes a spacer that withstands high temperatures. In that case, three individual supports made of a hard elastic material are held together by a spring-steel bow. This spacer proved itself in practice. However, it is altogether costly.

DE-C-1 515 832 describes a spacer in which the spoke-shaped spacers are made of different materials. The part which rests against the inner conductor exclusively comprises a radially outward protruding crosspiece made of polyvinyl-carbazole, a brittle material which has a high thermal load capacity. The ends of the crosspieces which rest against the outer conductor are made of flexible insulation material. They are configured as expanded rockers. The publication does not specify how the two different materials are interconnected. In addition, this spacer is costly as well.

SUMMARY OF THE INVENTION

It is an object of the invention to configure a spacer in a way so that it is simple to construct and has a high thermal load capacity.

This object is fulfilled by the invention in that the parts, which are made of different materials and are radially superimposed, are mechanically interconnected in the installed condition.

When it is made of the proper material, this spacer has a high thermal load capacity, as well as being simple to construct and cost-effective. A high-temperature resistant material is used for the part of the spacer that rests against the inner conductor. This material can be polytetra-fluorethylene (PTFE) or fluoridated ethylene-propylene (FEP). This part of the spacer is kept as small as possible in the radial direction. Lower cost materials with high dielectric properties may be used for the part of the spacer that is located radially outward of the part of the spacer adjacent the inner conductor. The parts of the spacer (two or more) can be joined by interlocking protrusions and cut-outs, or also by cementing the unit when it is finished, or in the installed condition, into a solid single-piece structure. This can already take place during the preliminary mounting. However, the parts can also be joined during the production of the HF cable. Even though the farther outside lying material does not have such a high thermal load capacity, the result is a cost-effective, high grade dielectric spacer with a high thermal load capacity.

The invention will be fully understood when reference is made to the following detailed description taken in conjunction with the accompanying drawing.

DETAILED DESCRIPTION OF THE INVENTION

Figure 1:
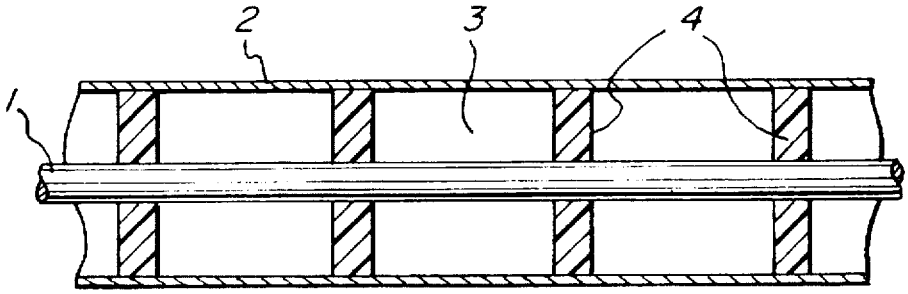
FIGS. 1 and 2 are longitudinal cross sectional views of two different HF cables.
Figure 2:
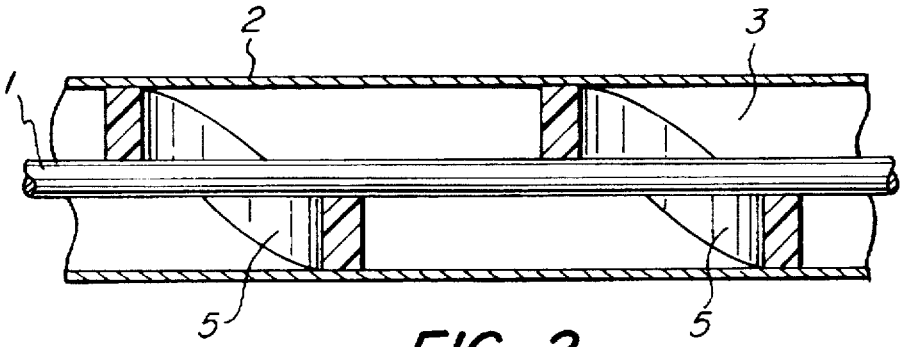

FIGS. 1 and 2 schematically illustrate a coaxial HF cable. It comprises an inner conductor 1 and a tube-shaped outer conductor 2, between which the dielectric cavity 3 is located. Preferably, both conductors 1 and 2 are made of copper.

The dielectric cavity 3 contains a spacer which coaxially connects the inner conductor 1 and the outer conductor 2 with each other. According to FIG. 1, the spacer comprises disks 4 arranged at an axial distance from each other on the inner conductor 1. The outer conductor 2 rests on the outside of the disks 4. According to FIG. 2, a strand 5 is used as the spacer which is helically wound around the inner conductor 1. The outer conductor 2 rests against the outside of the strand 5. Instead of the disks 4 and the strand 5, individual supports which are attached to the inner conductor 1 can also be used as a spacer.

Figure 3:
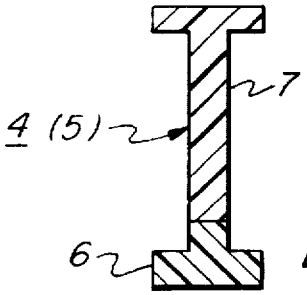
FIG. 3 is a cross sectional view of an element of a spacer according to the invention.

FIG. 3 illustrates a cross-section through a disk 4 of the spacer. Accordingly, it comprises two parts 6 and 7 which are interconnected in the finished spacer. The part 6 is designed to be applied to the inner conductor 1 of an HF cable. It is made of an insulation material with a high thermal load capacity, such as polytetra-fluorethylene or fluoridated ethylene-propylene. Its radial dimensions are kept as small as possible and result from the expected temperature range between inner and outer conductors at maximum power input to the HF cable. Part 7 is made of a high grade dielectric insulation material whose thermal load capacity is lower. For example, polyethylene can be used for the part 7.

Figure 4:
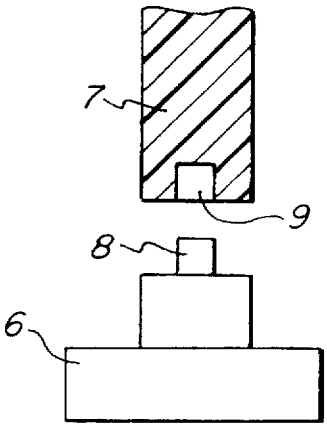
FIGS. 4 and 5 illustrate the element in FIG. 3 in two different configurations in separate and enlarged forms.
Figure 5:
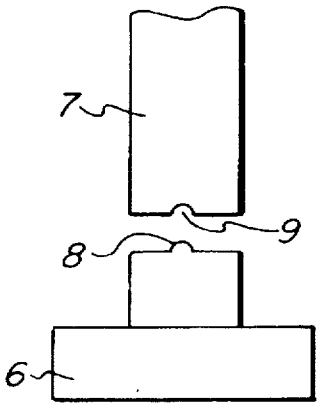

In the finished spacer, the parts 6 and 7 are interconnected. This can basically be achieved by cementing, i.e., by applying an adhesive to the surfaces to be connected. However, according to FIGS. 4 or 5, the part 6 can have protrusions 8 which engage in the cut-outs 9 of part 7 by means of tongue and groove configurations when the two parts are joined. Protrusions 8 and cut-outs 9 can also be alternately located in the other part or in both parts. In FIGS. 4 and 5, part 6 can be adhesively connected to part 7.

The described construction of a disk 4 applies equally to the helically wound strand 5, which is made up of two radially superimposed partial strands. In this case, the protrusions 8 and cut-outs 9 can extend without interruption over the entire length of the two partial strands. However, separate protrusions 8 with corresponding cut-outs 9 can also be used. The partial strands can also be continuously cemented to each other.

The described construction of disks 4 and strand 5 also applies analogically if these elements of the spacer are, or will be, made of more than two radially superimposed parts.

Both the disks 4 and the strand 5 can be produced by joining the parts 6 and 7 during preproduction, i.e., before they are applied to the inner conductor 1. They are then applied in a continuous manner to the inner conductor 1, which moves lengthwise. Accordingly, the outer conductor 2 can be formed around the spacer during the same operation. It is also possible to first apply the part 6 of the spacer to the inner conductor 1, and then to join part 7 to part 6. This solution is especially useful when the strand 5 is used as the spacer.

The preferred embodiments described above admirably achieve the objects of the invention. However, it will be appreciated that departures can be made by those skilled in the art without departing from the spirit and scope of the invention which is limited only by the following claims.

What is claimed is:

1. A spacer for a high-frequency coaxial cable with an inner conductor, a tube-shaped outer conductor and a dielectric cavity located between the two conductors, which comprises a first part adjacent the inner conductor and a second part spaced from the inner conductor, the parts are made of different materials so that the first part has a higher thermal load-carrying capacity than the second part, the parts are superimposed in a radial direction and are mechanically interconnected.

2. A spacer as claimed in claim 1, wherein parts are connected to each other by means of interlocking protrusions and cut-outs.

3. A spacer as claimed in claim 1, wherein the parts are interconnected by means of tongue and groove configurations.

4. A spacer as claimed in claim 1, wherein the parts are cemented to each other.

5. A spacer as claimed in claim 1 having a disk-like shape.

6. A spacer as claimed in claim 1, having a shape of a strand which is helically wrapped around the inner conductor.

7. A high-frequency coaxial cable comprising:

(a) an inner conductor;

(b) a spacer on the inner conductor, the spacer having a first part adjacent the inner conductor and second part spaced from the inner conductor, the parts are made of different materials so that the first part has a higher thermal load-carrying capacity than the second part, the parts are superimposed in a radial direction and mechanically interconnected; and (c) a tube-shaped outer conductor surrounding the inner conductor and the spacer to create a dielectric cavity located between the inner and outer conductors.

8. A high-frequency coaxial cable as claimed in claim 7, wherein the parts of the spacer are connected to each other by means of interlocking protrusions and cut-outs.

9. A high-frequency coaxial cable as claimed in claim 7, wherein the parts are interconnected by means of tongue and groove configurations.

10. A high-frequency coaxial cable as claimed in claim 7, wherein the parts are cemented to each other.

11. A high-frequency coaxial cable as claimed in claim 7, wherein the spacer is at least one disk.

12. A high-frequency coaxial cable as claimed in claim 7, wherein the spacer is a strand helically wrapped around the inner conductor.

13. A method of producing a high-frequency coaxial cable, comprising the steps of:

(a) providing an inner conductor;

(b) applying a spacer to the inner conductor, the spacer having a first part adjacent the inner conductor and a second part spaced from the inner conductor, the parts are made of different materials so that the first part has a higher thermal load-carrying capacity than the second part, the parts are superimposed in the radial direction and mechanically interconnected; and (c) forming a tube-shaped outer conductor around the inner conductor and the spacer to form a dielectric cavity located between the inner and outer conductors.

14. A method as claimed in claim 13, wherein the parts are connected to each other by means of interlocking protrusions and cut-outs.

15. A method as claimed in claim 13, wherein the parts are interconnected by means of tongue and groove configurations.

16. A method as claimed in claim 13, wherein the parts are cemented to each other.

17. A method as claimed in claim 13, wherein the spacer is at least one disk.

18. A method as claimed in claim 13, wherein the spacer is a strand helically wrapped around the inner conductor during the applying step.

19. A method as claimed in claim 13, wherein, during the applying step, the spacer is applied to the inner conductor which moves in a lengthwise direction.

20. A method as claimed in claims 13, wherein, during the applying step, the parts of the spacer are interconnected sequentially to the inner conductor which moves in a lengthwise direction.

* * * * *